United States Patent [19]

Sparling

[11] Patent Number: 4,967,612

[45] Date of Patent: Nov. 6, 1990

[54] FLARE NUT WRENCH

[76] Inventor: Russell Sparling, 943 Tunk Hill Rd., Foster, R.I. 02825

[21] Appl. No.: 420,982

[22] Filed: Oct. 13, 1989

[51] Int. Cl.[5] ..... B25B 13/28

[52] U.S. Cl. ..... 81/64; 81/111

[58] Field of Search ..... 81/92, 94, 98, 100, 81/99, 111, 112, 117, 64

[56] References Cited

U.S. PATENT DOCUMENTS

| | | | |
|---|---|---|---|
| 610,450 | 9/1898 | Johnston | 81/98 |
| 1,499,552 | 7/1924 | Reynolds | 81/111 |
| 2,708,855 | 5/1955 | Fish | 81/177.85 X |
| 3,668,950 | 6/1972 | Tyler | 81/111 X |

FOREIGN PATENT DOCUMENTS

| | | | |
|---|---|---|---|
| 1004514 | 2/1977 | Canada | 81/99 |
| 583635 | 8/1933 | Fed. Rep. of Germany | 81/64 |
| 2554427 | 12/1976 | Fed. Rep. of Germany | 81/64 |
| 488360 | 9/1928 | France | 81/64 |

*Primary Examiner*—D. S. Meislin

*Attorney, Agent, or Firm*—Millen, White & Zelano

[57] ABSTRACT

A flare nut wrench is configured to minimize the possibility of the flare nut wrench slipping by having the socket of the wrench pivoted to a base portion at a point in spaced relation to a prong extending from the base portion. The prong has a prong face thereon, which engages an external face on the socket to squeeze the socket about the flare nut when one applies torque to the flare nut by applying force to a handle attached to the base. By squeezing the socket wrench about the flare nut, the tendency of the socket to slip and round off the flare nut is counteracted by the force applied to the socket by the prong.

13 Claims, 1 Drawing Sheet

FLARE NUT WRENCH

BACKGROUND OF THE INVENTION

The instant invention relates to flare nut wrenches, and more particularly the instant invention relates to flare nut wrenches which include a non-slip feature.

With the conventional flare nut or tube nut wrench, there is a tendency for the wrench to slip if too much force is applied. This is because flare nuts are generally made of a relatively soft material, such as brass, so that excessive torque applied by a wrench to the nut causes the corners of the nut to round off, resulting in wrench slippage. Due to the configuration of conventional flare nut wrenches, excessive torque can also cause jaw slippage and spreading due to the open end configuration of the wrenches. Because of this slippage problem, manufacturers of flare wrenches frequently include disclaimers with their products since, from time to time, a person trying to tighten or release the flare nut is injured when a wrench slips.

The patent literature fails to disclose any patents which adequately address this problem. U.S. Pat. No. 3,668,950 discloses a structure in which the handle of the wrench presses against a pivotal jaw as the wrench is used. However, this patent is not particularly suitable for flare nuts.

U.S. Pat. No. 2,618,996 discloses a wrench specifically used for tightening nuts; however, the patent relies on a pair of opposed jaws rather than an open socket which is squeezed by a rigid prong projecting from the handle.

U.S. Pat. No. 2,655,064 discloses a handle with a prong and a pivoted jaw; however, the pivoted jaw is not pressured by the prong to squeeze the jaw tightly about a nut.

In view of the shortcomings of the prior art, there is a need for a wrench specifically suitable for flare nuts which is convenient to use and does not slip.

SUMMARY OF THE INVENTION

It is an object of the instant invention to provide a new and improved flare nut wrench which is resistant to slippage when used. Upon further study of the specification and appended claims, further objects and advantages of this invention will become apparent to those skilled in the art.

In view of this and other objects, the instant invention contemplates a flare nut wrench comprised of a handle with a prong projecting therefrom and an open socket pivoted thereon adjacent the handle wherein, when in use, the prong presses against an outer surface of the socket and squeezes the socket against the flare nut.

In accordance with one embodiment of the invention, the prong is offset laterally of the axis of the handle in one direction, while the pivot point of the socket is offset laterally of the axis of the handle in the opposite direction defining a space between the pivot and prong for receiving the open sprocket when the open sprocket is slipped over the flare nut and the handle rotated to swing the prong into position against the socket.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

DETAILED DESCRIPTION

Figure 1:
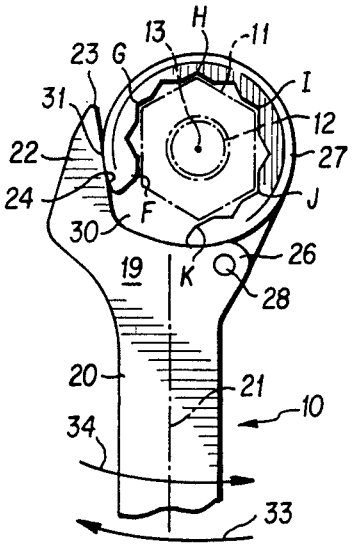
FIG. 1 is a planar view of the flare nut wrench of the instant invention shown in a closed mode.

Referring now to FIG. 1, there is shown a flare nut wrench, designated generally by the numeral 10, configured in accordance with the principles of the instant invention and made of steel such as chrome vanadium steel. Any appropriate steel or other material can be used to make the wrench of the invention as long as it possesses satisfactory properties, such as hardness, e.g., analogous to those of chrome vanadium steel. The flare nut wrench 10 is used to loosen or tighten a flare nut 11 (shown in dotted lines) which secures a tube 12 (shown in dotted lines), such as a brass tube, to a fitting (not shown). The flare nut 11 is usually made of brass and is, therefore, relatively soft. The flare nut wrench 10 is configured to grip the flare nut 11 in a manner which discourages slippage.

Figure 2:
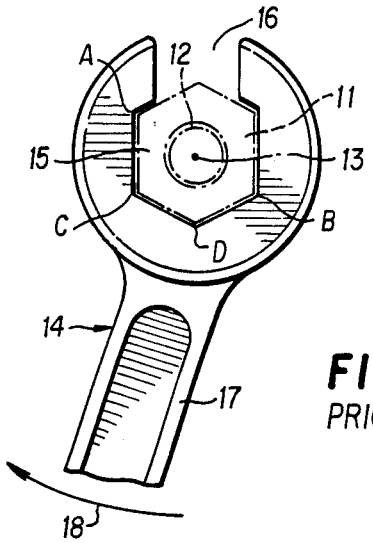
FIG. 2 PRIOR ART
FIG. 2 is a planar view of the prior art flare nut wrench.

Referring now to FIG. 2, there is shown a flare nut wrench, designated generally by the numeral 14, configured in accordance with the structure of the prior art, wherein the socket portion 15 of the flare nut has a gap 16 therein, allowing the socket 15 to slide over a tube such as the tube 12. Thereafter, the flare nut wrench 14 is moved in the direction of the axis 13 of the tube 12 over the flare nut 11. The difficulty with flare nut wrenches such as the flare nut wrench 14 is that as a force is applied to the handle 17 in the direction of arrow 18, points C and D lose contact with the nut 11, while points A and B remain in contact. This lessens the number of points of contact to only two which, of course, increases the force at the points of contact A and B and tends to round off the corner of the flare nut 1. If this happens suddenly, the person using the wrench 14 can injure his or her hand. Once the flare nut 11 is rounded off, one can no longer loosen or tighten the flare nut without the use of a binding wrench such as a small pipe wrench. Applicant's flare nut wrench 10 solves this problem inherent in the prior art flare nut wrench 14 of FIG. 2 by increasing the gripping force on the flare nut 11 as force is applied to wrench handle 20.

Figure 3:
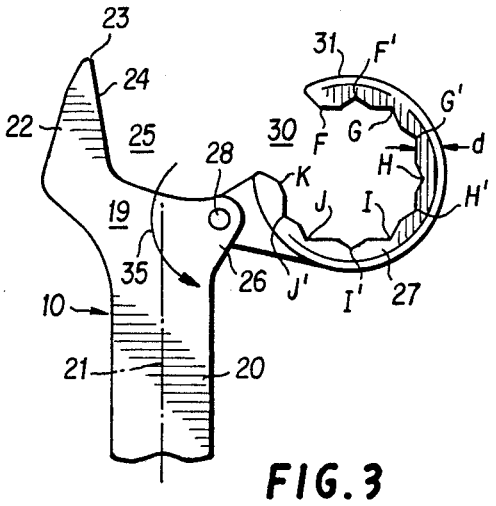
FIG. 3 is a planar view of a flare nut wrench configured in accordance with the principles of the instant invention shown in an open mode.

As is seen in FIGS. 1 and 3, the flare nut wrench 10 has handle 20 extending in the direction of axis or axial line 21. The handle provides a base 19. Offset laterally from the axis 21 of the handle 20 and projecting laterally from the base 19 is a prong 22, which tapers to a point 23 and has an inner surface 24, extending in the general direction of axial line 21 and which faces a space 25.

Projecting laterally from the handle 20 in a direction opposite the prong 22 is a lug 26 into which an open socket 27 is pivoted via a pivot pin 28. The open socket 27 defines a space 29 which receives the lug nut 11 of FIG. 1. The socket 27 has a gap 30 therein so that it can slip around the tube 12 prior to being moved axially so as to slip around the flare nut 11. The socket extends substantially more than 180° around area 29 and preferably at least 270° around the area before being interrupted by the gap 30. The socket 27 has six engagement points formed by angular contact areas F, G, H, I, J, and K, which engage complementary corners in the hexagonal flare nut 11. Angular contact areas F and K are directly adjacent the gap 30.

After the socket 27 has been slipped around the flare nut 11 by sliding it parallel to the axis of the tube 12 and the flare nut, the handle 20 is rotated about the pivot 28 to bring the prong face 24 into engagement with a face 31 on the socket 27, as is shown in FIG. 1. Since the socket 27 is restrained from movement due to its engagement with the flare nut 11, continued movement of the handle causes the prong face 24 to apply pressure to the socket face 31. This squeezes the socket 27 so as to counteract any tendency of the gap 30 to open. Since pushing the handle 20 in the direction of the arrow 33 squeezes the socket 27 more tightly against the flare nut 11, the possibility that the socket 27 will slip is substantially eliminated. Generally, when one is tightening a flare nut 11, as is shown in FIG. 1, the handle 20 is urged in the direction of arrow 33. In order to loosen the nut 11, the flare nut wrench is simply flipped over, again slipped over the nut 11, and pushed in the direction of arrow 34. After the flare nut 11 has been loosened or tightened, the handle 20 is simply pivoted in the direction of arrow 35 about pin 28 so as to disengage the prong face 24 from the socket face 31.

As is seen in FIG. 3, the socket 27 has disposed between the angular contact areas F, G, H, I, J, and K further angular contact areas F', G', H', I', and J', which allow one to index the wrench 10 in 30. increments, rather than the 60° increments of the prior art wrench of FIG. 2. This provides a more convenient tool for working in tight spaces which may restrict handle movement. The convenience of the wrench 10 of FIGS. 1 and 3 is further enhanced because the socket 27 has a relatively thin wall "d", allowing the socket to fit through tighter spaces. Moreover, since the socket wall "d" is relatively thin, it is flexible and can, therefore, be squeezed tightly about the nut 11 as it is pressed by the prong 22. The greater the torque applied by the handle 20, the tighter the socket 27 squeezes nut 11.

Figure 4:
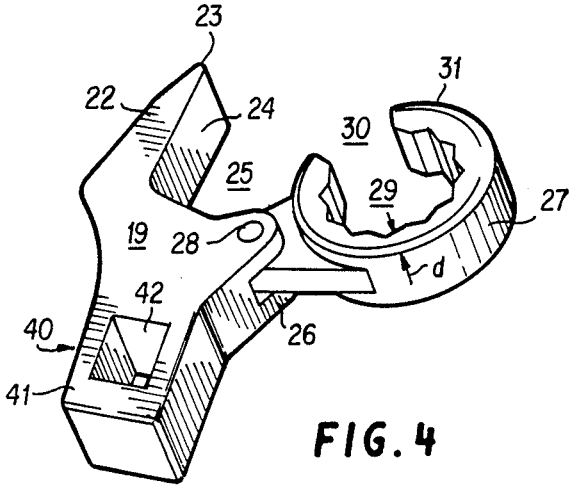
FIG. 4 is a perspective view the flare nut wrench of the invention configured as a crowfoot wrench operable by a conventional socket wrench extension.

Referring now to FIG. 4, there is shown a second embodiment of the invention, wherein a crowfoot flare nut wrench 40 has all of the components of the flare nut wrench 10 of FIGS. 1 and 3, except that the handle 20 is replaced by a lug 41 which has a recess 42 therein for receiving an extension (not shown) utilized with a standard socket wrench. The crowfoot wrench 40 is used where there is insufficient room to swing the handle 20 of a conventional wrench 10.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A flare nut wrench comprising:

a resilient socket having an internal surface defining an area for receiving a flare nut, the internal surface being used for gripping engagement with the external surface of a flare nut, the socket having an outer socket face and having a gap therein through which a tube secured by the flare nut passes prior to engaging the socket with the flare nut;

a base having an axial line extending therethrough, a socket pivot on the base positioned on one side of the axial line for pivoting the socket with respect to the base;

a prong projecting from the base on the other side of the axial line at a location spaced laterally of the socket pivot, the prong having a prong surface extending in the general direction of the axial line for engagement with the outer face of the socket;

said gap extending totally between the prong and the socket pivot when the outer socket face is engaged by said prong, said gap extending for a selected circumferential distance such that it remains open upon engagement of the socket with the flare nut and prong; and handle means associated with the base for applying torque to the wrench to rotate the flare nut, the handle means urging the prong surface against the outer face of the socket to squeeze the socket against the external surface of the flare nut so as to prevent the gap from opening and to thereby prevent the wrench from rounding off the flare nut.

2. The flare nut wrench of claim 1, wherein the handle means for applying torque to the wrench is a handle which is coextensive with the axial line in a direction perpendicular to the axis of the pivot for the socket.

3. The flare nut wrench of claim 1, wherein the base includes a socket therein for receiving an extension of a socket wrench and wherein the handle means for applying torque to the base is a socket wrench handle having an extension thereon.

4. The flare nut wrench of claim 1, wherein the gap in the socket is positioned adjacent the socket pivot and faces the base when the outer surface of the socket is engaged by the prong.

5. The flare nut wrench of claim 1, wherein the socket pivot is positioned in a lug which projects laterally of the base, while the prong projects both laterally of the base and extends in the general direction of the axial line.

6. The flare nut wrench of claim 1, wherein the internal surface of the socket has at least five angular contact areas for gripping a hexagonal flare nut, two of the angular contact areas being adjacent the gap.

7. The flare nut wrench of claim 1, wherein all components thereof are made of steel.

8. The flare nut wrench of claim 1, wherein the internal surface of the socket has at least 11 angular contact areas wherein alignment with a hexagonal flare nut for regripping the nut can be accomplished by indexing the socket 30.

9. The flare nut wrench of claim 1, wherein the socket has a relatively thin wall so as to be flexible and bendable under pressure by the prong.

10. The flare nut wrench of claim 1, wherein the prong surface is substantially smooth.

11. The flare nut wrench of claim 1, wherein the prong is a single unitary element of which the prong surface is part and wherein the socket extends substantially more than 180° around the area receiving the flare nut.

12. The flare nut wrench of claim 11, wherein the socket extends at least 270 ° around the area receiving the flare nut.

13. The flare nut wrench of claim 12, wherein the gap substantially faces the base when the prong surface engages the outer face of the socket.

* * * * *